US005368404A

United States Patent [19]

Hacker

[11] Patent Number: 5,368,404

[45] Date of Patent: Nov. 29, 1994

[54] PRINTER ADAPTABLE APPARATUS FOR CUTTING PERFORATED PAPER

[76] Inventor: Ronald L. Hacker, 5123 Collins St., Pananma City, Fla. 32404

[21] Appl. No.: 151,912

[22] Filed: Nov. 15, 1993

Related U.S. Application Data

[63] Continuation-in-part of Ser. No. 11,427, Aug. 5, 1993, Ser. No. 11,656, Aug. 12, 1993, and Ser. No. 12,295, Aug. 30, 1993.

[51] Int. Cl.[5] ..... B41J 11/68

[52] U.S. Cl. ..... 400/621.1; 83/425

[58] Field of Search ..... 400/621, 621.1; 225/2, 225/93, 99, 100, 106, 101; 83/44, 425, 425.1, 431, 433, 435; D18/56

[56] References Cited

U.S. PATENT DOCUMENTS

| | | | |
|---|---|---|---|
| 1,998,357 | 4/1935 | Carlson | 83/425 X |
| 2,208,994 | 7/1940 | Mabon | 225/99 X |
| 4,175,460 | 11/1979 | McPhail | 83/425 X |
| 4,909,109 | 3/1990 | Crane | 83/425 X |
| 5,036,739 | 8/1991 | Clar | 83/425 X |
| 5,120,144 | 6/1992 | Lund | 400/621.1 |
| 5,144,891 | 9/1992 | McKenna | 400/621.1 X |
| 5,259,543 | 11/1993 | Downing | 400/621.1 X |

FOREIGN PATENT DOCUMENTS

| | | | |
|---|---|---|---|
| 2601291 | 1/1988 | France | 400/621.1 |

*Primary Examiner*—Edgar S. Burr
*Assistant Examiner*—Christopher A. Bennett
*Attorney, Agent, or Firm*—George A. Bode; Michael L. Hoelter

[57] ABSTRACT

A paper trimmer for separating perforated paper, such as the perforated end region of computer paper, as such paper passes along a printer. Movable blade means forming a part of the paper trimmer remain in alignment with the perforations as the paper is moved across the printer, such as through the use of a tractor. In this fashion, the perforations can continue to be separated by the paper trimmer without regard to the constantly moving location of the perforations.

17 Claims, 6 Drawing Sheets

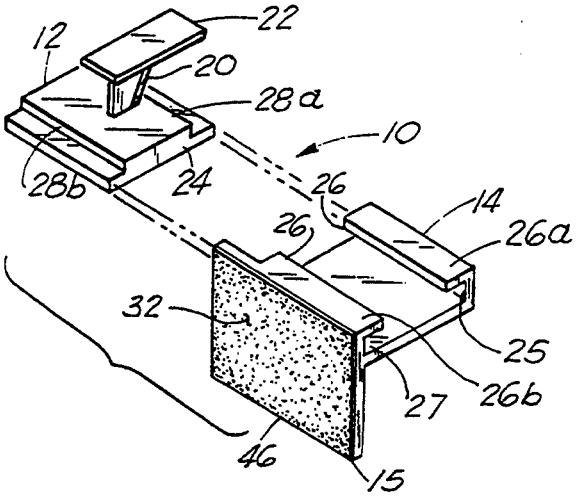
FIG. 7
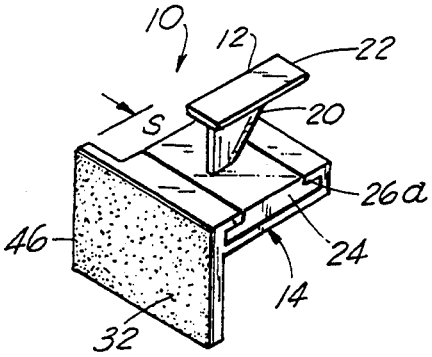
FIG. 1
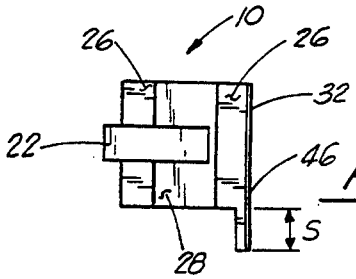
FIG. 2
FIG. 4
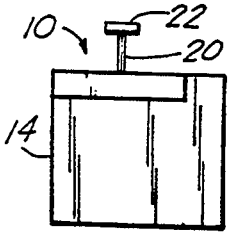
FIG. 5
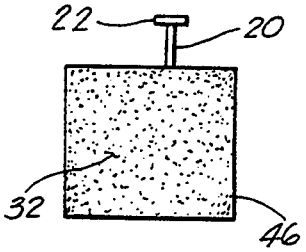
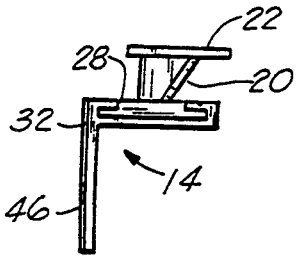
FIG. 3
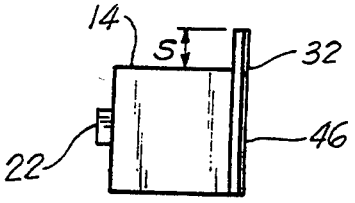
FIG. 6

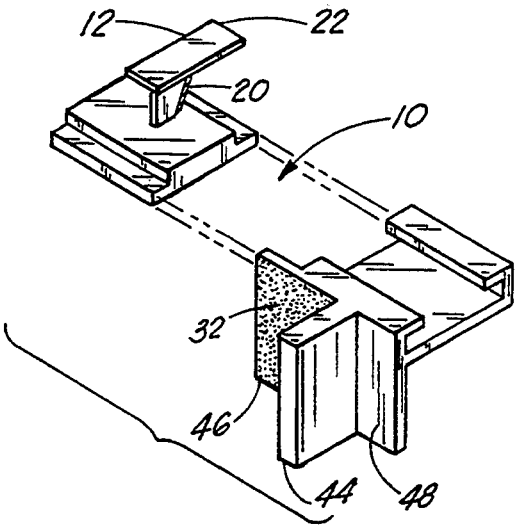
FIG. 16
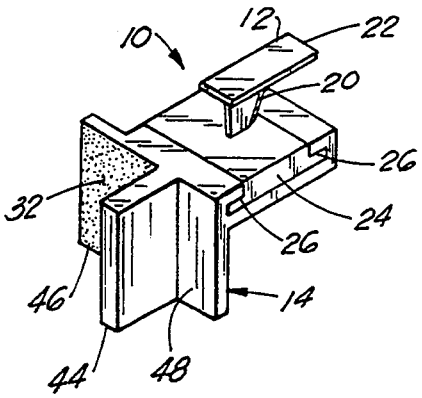
FIG. 10
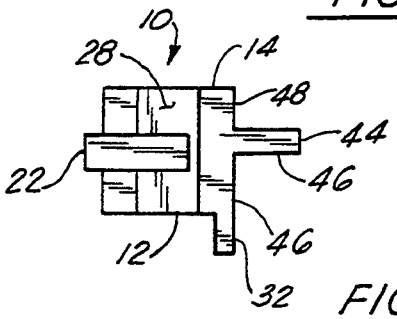
FIG. 11
FIG. 13
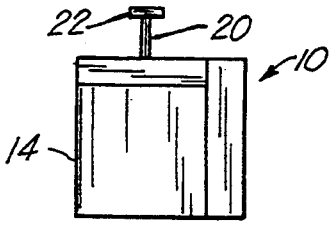
FIG. 12
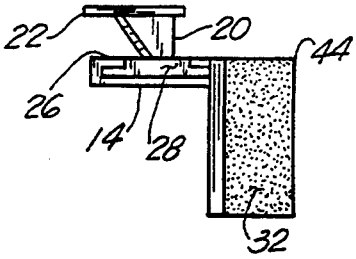
FIG. 14
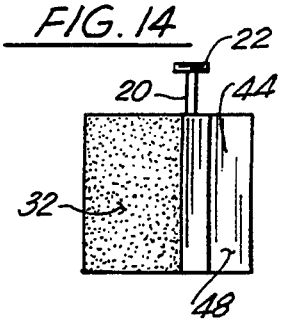
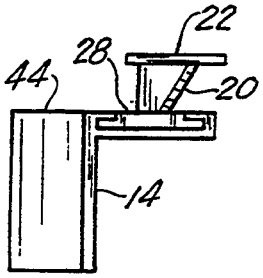
FIG. 17
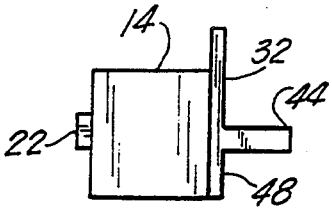
FIG. 15

PRINTER ADAPTABLE APPARATUS FOR CUTTING PERFORATED PAPER

This application is a continuation-in-part application of previous applications by the same inventor bearing U.S. Ser. No. 29/011,427 filed Aug. 5, 1993; U.S. Ser. No. 29/011,656 filed Aug. 12, 1993; and, U.S. Ser. No. 29/012,295 filed Aug. 30, 1993. The entire previous applications Serial No. 29/011,427; Ser. No. 29/011,656; and, Ser. No. 29/012,295 are incorporated herein by reference as if set forth in full below.

BACKGROUND OF THE INVENTION

1. Field of the Invention

This invention pertains to business machines in general and, more particularly, to a printer-mounted paper cutting or trimming apparatus, and more particularly, apparatus for the cutting and trimming of perforated paper.

2. General Background

Many devices currently exist for cutting and/or trimming paper. U.S. Pat. No. 4,993,856 issued to W. Chung discloses a device mounted on a printer that incorporates a slot over which the weakened or perforated line of paper moves. Should it be desired to separate the paper at these perforations, an overhead cutting blade is moved so as to extend into this slot, thereby separating the paper at these perforations as the paper passes over the slot. While this device would seemingly operate as intended, it requires a printer to either be manufactured with the slot therein or with space for a future slot should such a device be installed. Additionally, this device also requires a generally flat surface extending upstream of the slot for proper functioning which may not always be available since this may increase the bulk of the printer.

U.S. Pat. No. 4,152,962 issued to W. Hendrischk pertains to a paper cutter for a printer that incorporates a retractable stepped cutting wheel. This stepped cutting wheel is urged against a stationary cutting edge, thereby creating a tear point at the junction of the wheel and the stationary edge. While this device appears to be able to cut a straight edge almost anywhere desired, it does not seem able to cut along the perforated edge of computer paper. This is because, by its operation, both sides of the paper must be restrained which is unlikely to occur for the small strip along the edge of a computer sheet. Instead, this small strip is more likely to fold down over the stationary edge, thereby becoming wedged between the retractable wheel and the stationary edge.

U.S. Pat. No. 4,782,986 issued to R. Loesche pertains to a manual paper trimmer in which individual sheets of computer paper are inserted within the device. Upon closing the cutter, the to-be-trimmed edge of the paper is restrained therein such that the free end of the paper can be separated from the now clasped end. While this device is operable, its manual one-sheet-at-a-time operation makes the cutting and/or trimming of large quantities of paper unreasonable.

U.S. Pat. No. 4,211,498 issued to M. Shimizu, et al. discloses a paper cutter/perforator which operates transverse to the movement of the paper through the printer. This device is intended to create perforations rather than cut or tear the paper along perforations already existing.

It is thus an object of the present invention to provide a cutting/trimming apparatus which can be adapted to a variety of differently configured printers without requiring any conversion of the printer itself.

It is another object of the present invention to provide a cutting/trimming apparatus which quickly and efficiently trims perforated paper moving along the printer, such as the perforated edge of computer paper.

Still another object of the present invention is to provide a quick and simple apparatus which can be installed in minutes and one which is adjustable so as to remain in alignment with the perforations of the moving sheet of paper. These and other objects and advantages of the present invention will become obvious upon further investigation.

SUMMARY OF THE PRESENT INVENTION

The preferred embodiment of the apparatus of the present invention solves the aforementioned problems in a straightforward and simple manner. What is provided is a paper trimmer for trimming paper that incorporates a first generally fixed guide portion having a surface securable to a printer and a second movable blade retaining portion supported by the fixed guide portion. Alignment means are incorporated for permitting or enabling the movement of the movable blade retaining portion with respect to the fixed guide portion. Additionally, a blade is secured in the movable blade retaining portion for separating the paper passing before it with this blade retaining portion being configured with upper cap means for maintaining the paper against the blade.

BRIEF DESCRIPTION OF THE DRAWING

For a further understanding of the nature and objects of the present invention, reference should be had to the following description taken in conjunction with the accompanying drawing in which like parts are given like reference numerals and, wherein:

FIG. 1 is a top and rear perspective view of one embodiment of the apparatus of the present invention;

FIG. 2 is a top plan view of the embodiment of FIG. 1;

FIG. 3 is a left side elevational view of the embodiment of FIG. 1;

FIG. 4 is a front elevational view of the embodiment of FIG. 1;

FIG. 5 is a rear elevational view of the embodiment of FIG. 1;

FIG. 6 is a bottom plan view of the embodiment of FIG. 1;

FIG. 7 is a top and rear perspective exploded view of the embodiment of FIG. 1;

FIG. 10 is a top and rear perspective view of an alternate embodiment of the apparatus of the present invention;

FIG. 11 is a top plan view of the embodiment of FIG. 10;

FIG. 12 is a right side elevational view of the embodiment of FIG. 10;

FIG. 13 is a front elevational view of the embodiment of FIG. 10;

FIG. 14 is a rear elevational view of the embodiment of FIG. 10;

FIG. 15 is a bottom plan view of the embodiment of FIG. 10;

FIG. 16 is a top and rear perspective exploded view of the embodiment of FIG. 10;

FIG. 17 is a left side elevational view of the embodiment of FIG. 10;

DETAILED DESCRIPTION OF THE PREFERRED EMBODIMENT

Figure 8:
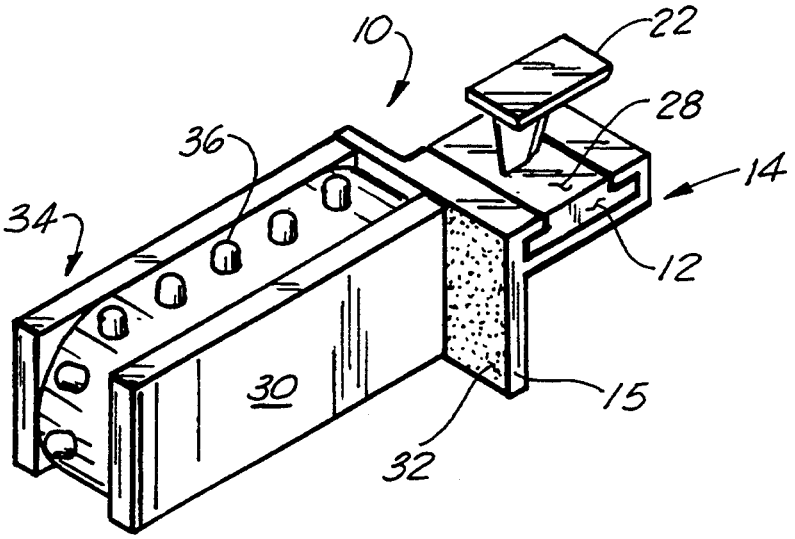
FIG. 8 is a pictorial view of the embodiment of FIG. 1 secured to a portion of a printer.
Figure 9:
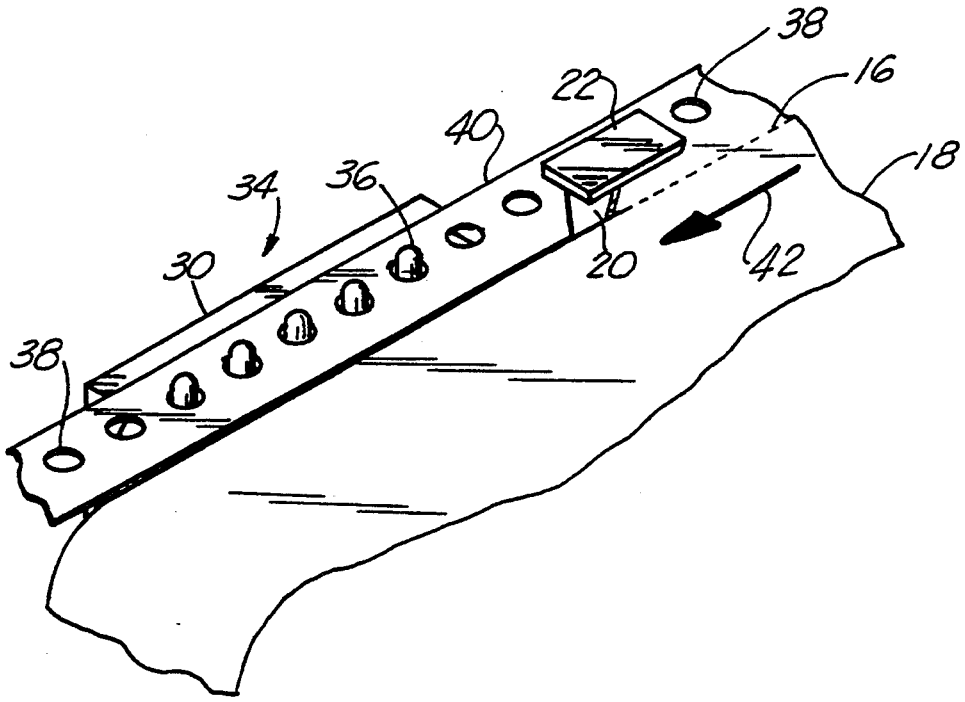
FIG. 9 is a pictorial view, partially cut away, illustrating the operation of the embodiment of FIG. 1.
Figure 18:
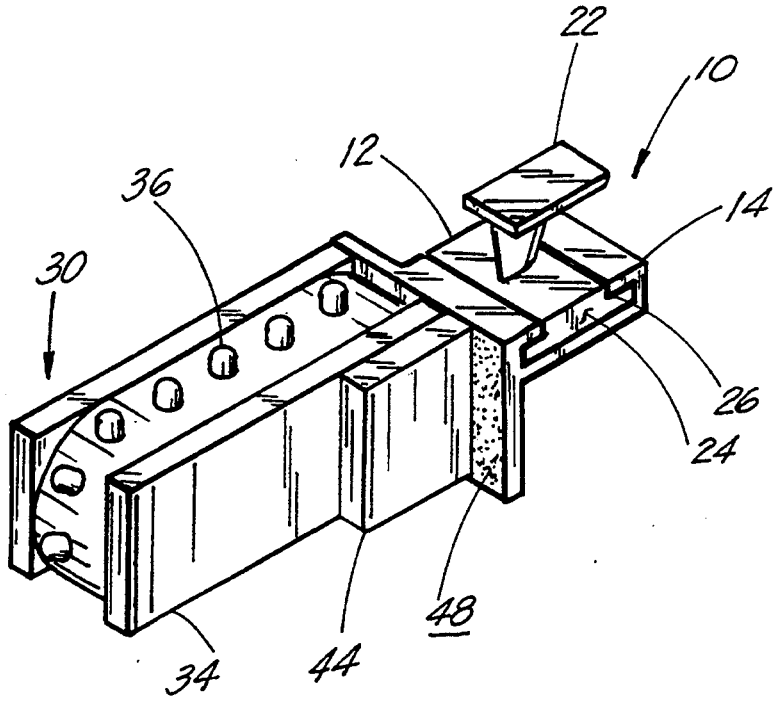
FIG. 18 is a pictorial view of the embodiment of FIG. 10 secured to a portion of a printer.

Referring now to the drawing, and in particular FIGS. 1–9, there is shown two part paper edge trimmer 10. In this embodiment, trimmer 10 is configured having a first movable blade retaining portion 12 and a second fixed guide support portion 14. As best seen in FIGS. 1, 3, 7 and 9, blade retaining portion 12 slides or moves within and with respect to guide support portion 14 so as to remain in alignment with perforations 16 of paper 18 during operation. Blade retaining portion 12 consists of manually removable blade 20 which may be a small taut wire, a wedge, a knife or any other device which will separate paper 18 along perforations 16. Blade 20, as illustrated, is angled or tapered downwardly and inwardly toward base 24, thereby having a base width smaller than its upper region width. This is to maintain paper 18 against blade 20 as paper moves across blade 20 as best seen in FIG. 9. In other embodiments, blade 20 may be straight or vertical or blade 20 may be tapered in the opposite direction. Blade 20 may be constructed of plastic, metal, rubber or any other rigid material.

Blade retaining portion 12 is generally located or mounted intermediate upper horizontal stop or cap 22 and lower base 24. This may be by integral molding. Upper stop 22 is configured to retain paper 18 against blade 20 and to prevent paper 18 from buckling or otherwise becoming disengaged from blade 20. Lower base 24 is configured to freely slide within channels 25, 27 of guide portion 14, thereby providing a movable support for blade 20.

Fixed guide portion 14 incorporates alignment tabs 26*a*, 26*b* that create channels 25, 27 and accept base 24 therein. These alignment tabs 26 retain base 24 within guide portion 14 while enabling base 24 to move laterally as needed. As best illustrated in FIGS. 1, 3 and 8, alignment tabs 26 extend over the marginal edges of and engage a portion of lower base 24, in fact, generally base 24 has stepped edges or shoulders 28*a*, 28*b*, as best seen in FIG. 7, thereby providing means for guiding base 24 between tabs 26 yet permitting base 24 to freely slide as needed. Additionally, alignment tabs 26 and stepped shoulders 28 prevent the movement of base 24 in a transverse direction (such as ARROW 42 of FIG. 9).

Extending downwardly from the side of guide 14 where tab 26*b* is located is integral panel or wall 46. This surface also extends laterally beyond the width of guide 14 a distance "s," best seen in FIGS. 1, 2 and 6.

Fixed guide portion 14 can be mounted on a conventional printer portion 30 such as through the use of an adhesive pad 32 or the like applied to the outer surface 15 of downwardly depending wall 46. Other means (such as VELCRO) of securing fixed guide portion 14 to printer portion 30 are also likely. In the embodiment of FIGS. 1–9, adhesive pad 32 extends fully across one side or face 15 of guide portion 14. When properly installed, the range of movement of blade 20 is such that it remains in alignment with the range of movement of perforations 16 on paper 18 travelling across printer portion 30 best seen in FIG. 9.

FIGS. 8 and 9 disclose tractor means 34 forming a part of printer portion 30. These tractor means 34 incorporate a series of raised nubs 36 which coincide with openings 38 normally found in the perforated edge region 40 of paper 18. During operation, nubs 36 will pass through openings 38, thereby moving paper 18 transversely in the direction of ARROW 42 whenever nubs 36 are likewise moved. Such transverse movement of paper 18 will cause perforations 16 to engage blade 20 which, when moving across trimmer 10, will force the separation of perforated end region 40 from the remainder of paper 18.

Referring now to FIGS. 10–18, another embodiment of the present invention is disclosed for adaptation to another configuration of printer portion 30 of a printer (not shown). In this embodiment, movable blade retaining portion 12 retains generally the same configuration while fixed guide portion 14 has been modified for adaptation to a particular printer portion 30. This adaptation includes the use of transversely depending guide member 44 secured to attachment side 46 of guide portion 14. Guide member 44 effectively defines adhesive pad 32 and the area to be secured to printer 30. In this embodiment, the remaining portion of attachment side 46, or area 48, contains no adhesive since it is not to be in contact with printer portion 30. Generally all other features of this embodiment will be the same as shown and described with respect to the embodiment of FIGS. 1–9.

FIGS. 19–25 illustrate yet another embodiment of the present invention for adaptation to yet another configuration of printer having printer portion 30. As illustrated, movable blade retaining portion 12 can be configured differently by eliminating stepped edges or shoulders 28 which are shown in the earlier embodiments. Additionally, adhesive pad 32 is secured to and extends across the entirety of the face of downwardly depending attachment panel 46, yet, in this embodiment, attachment side 46 is located and depends downwardly intermediate alignment tabs 26 on the under side 63 of guide portion 14. Consequently, this embodiment illustrates trimmer 10 wherein adhesive pad 32 is inset from one edge of guide portion 14 rather than being flush with this edge. Further, additional adhesive surface 33 is provided on the portion of under side 63 adjacent surface 32.

Figure 33:
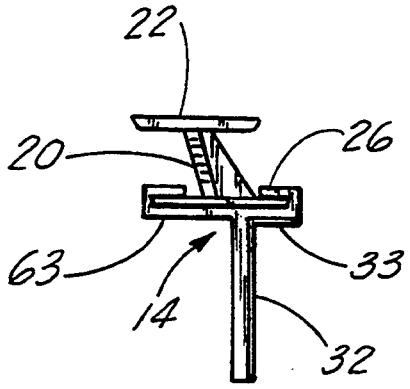
Figure 25:
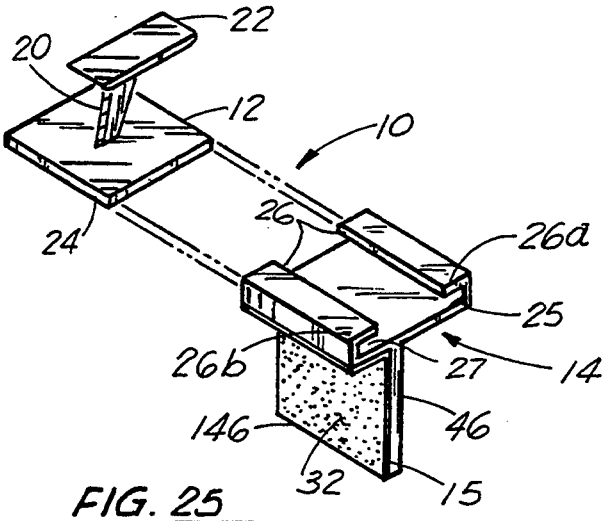
FIG. 25 is a top and rear perspective exploded view of the alternate embodiment of FIG. 19.
Figure 19:
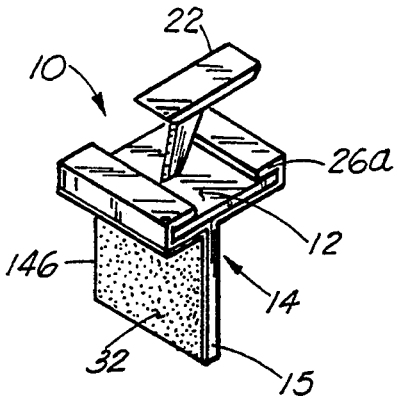
FIG. 19 is a top and rear perspective view of another alternate embodiment of the apparatus of the present invention.
Figure 20:
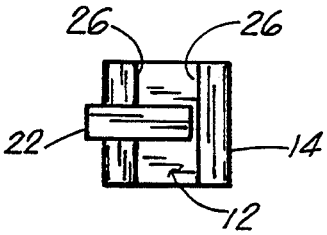
FIG. 20 is a top plan view of the alternate embodiment of FIG. 19.
Figure 22:
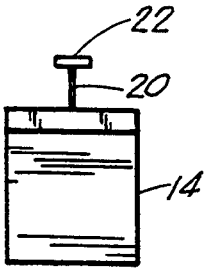
FIG. 22 is front elevational view of the alternate embodiment of FIG. 19.
Figure 21:
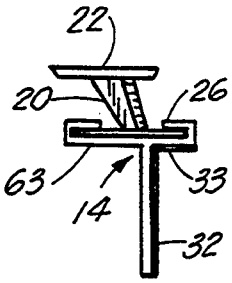
FIG. 21 is a right side elevational view of the alternate embodiment of FIG. 19.
Figure 23:
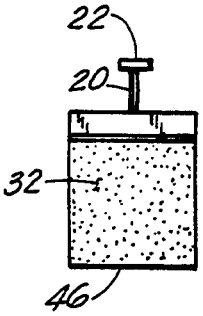
FIG. 23 is a rear elevational view of the alternate embodiment of FIG. 19.
Figure 24:
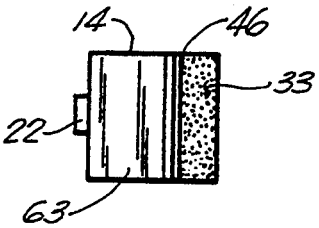
FIG. 24 is a bottom plan view of the alternate embodiment of FIG. 19.
Figure 32:
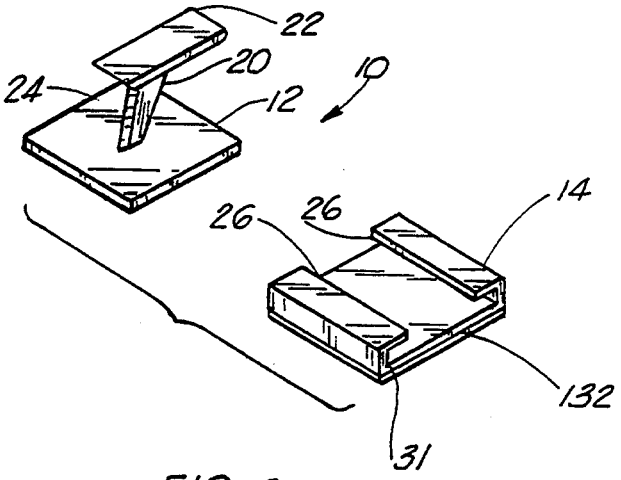
FIG. 32 is a top and rear perspective exploded view of the alternate embodiment of FIG. 26; and, FIG. 33 is a right side elevational view of yet another alternate embodiment with the blade means having an upward whereby the lower region thereof is larger than the upper region.
Figure 26:
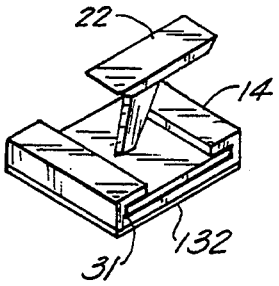
FIG. 26 is a top and rear perspective view of still another alternate embodiment of the apparatus of the present invention.
Figure 27:
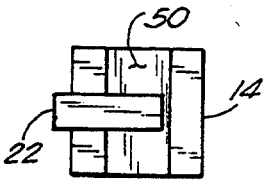
FIG. 27 is a top plan view of the alternate embodiment of FIG. 26.
Figure 29:
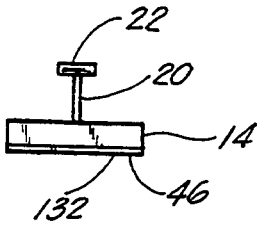
FIG. 29 is a front elevational view of the alternate embodiment of FIG. 26.
Figure 28:
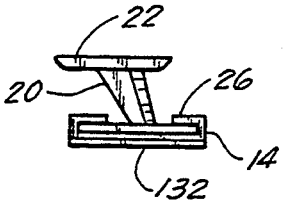
FIG. 28 is a right side elevational view of the alternate embodiment of FIG. 26.
Figure 30:
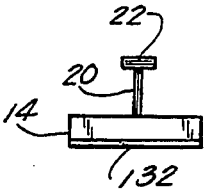
FIG. 30 is a rear elevational view of the alternate embodiment of FIG. 25.
Figure 31:
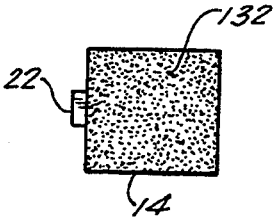
FIG. 31 is a bottom plan view of the alternate embodiment of FIG. 26.

FIG. 33 illustrates the embodiment of FIGS. 19–25, the right side view being the same as FIG. 21 except that blade 20 has an upward taper whereby the lower region thereof is larger than the upper region.

FIGS. 26–32 illustrate still another embodiment of the present invention for adaptation to still another configuration of printer portion 30. In this embodiment, guide portion 14 of trimmer 10 contains no guide of downwardly extending member 46 as incorporated in the above embodiments. Instead, guide portion 14 has a generally planar base 24 with adhesive pad 132 secured to the under side 31 thereto. This planar base 24 is secured to an upper surface of printer portion 30 so as to mount blade portion 12 in alignment with perforations 16 of paper 18.

No matter which embodiment of the present invention is used, the operation of trimmer 10 would be generally the same. After affixing guide portion 14 to printed portion 30 in the appropriate manner (such as by the use of adhesive pad 32), movable blade retaining portion 12 is inserted in guide portion 14. Care must be taken so that the range of lateral movement of blade retaining portion 12 as provided by guide portion 14 coincides with perforations 16 on paper 18. Thus, as tractor means 34 moves paper 18 in the normal longitudinal (ARROW 42 IN FIG. 9) fashion, perforations 16 bias or press against blade 20. As a result of such biasing against blade 20, these perforations 16 are separated, thereby causing perforated end region 40 to become removed from the remainder of paper 18.

Additionally, as paper 18 travels across trimmer 10 (ARROW 42 of FIG. 9), such movement may cause perforations 16 to also move slightly. Blade 20 is capable of remaining in alignment with such moving perforations 16 due to the ability of blade retaining portion 12 to move laterally in channels 25, 27 with respect to guide portion 14. As perforations 16 are biased against blade 20, such biasing causes blade retaining portion 14 to move as needed so as to remain in alignment.

While several embodiments have been disclosed in order to adapt trimmer 10 to a variety of different printer configurations, other embodiments also exist and are to be deemed to be covered by this invention.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. An apparatus mountable on a printer for trimming paper moving through said printer, comprising:

(a) a guide portion mountable on said printer, said guide portion further comprising a guide member downwardly extending from and secured to a bottom surface of said portion, said guide member having an adhesive surface attachment to said printer;

b) a blade retaining portion having a base accepted by said guide portion;

c) means for permitting the movement of said retaining portion with respect to said guide portion;

d ) blade means mounted to the base of said blade retaining portion for trimming paper as said paper moves through said printer and is biased against said blade means: and, e ) means secured to an upper portion of said means for maintaining said paper against said blade means.

2. The apparatus as set forth in claim 1, wherein said adhesive surface is provided on a generally flat surface of said downwardly extending guide member, said flat surface being generally parallel to the direction of movement of said slidable base within said guide portion.

3. The apparatus as set forth in claim 2 wherein said downwardly extending guide member is flush with one edge of said guide portion.

4. The apparatus as set forth in claim 2 wherein said downwardly extending guide member is spaced from an edge of said guide portion.

5. The apparatus as set forth in claim 2 wherein said blade means is oriented at a generally downward taper thereby having a lower region smaller that its said upper region.

6. The apparatus as set forth in clam 2 wherein said blade means is oriented in a generally vertical direction.

7. The apparatus as set forth in claim 2 wherein said blade means is oriented at a generally upward taper thereby having a lower region larger that its said upper region.

8. The apparatus as set forth in claim 1 wherein said base of said blade retaining portion has opposing shoulder portions for slidable acceptance within a pair of opposing channels provided within said guide portion.

9. The apparatus as set forth in claim 8 wherein said blade retaining portion is movable in a lateral direction within said guide portion only for maintaining alignment with said paper.

10. An apparatus mountable on a printer for trimming paper moving through said printer, comprising:

(a) a guide portion mountable on said printer and opposing channel members provided in an upper portion thereof:

(b) a blade retaining portion having a base slidably accepted by said channel members of said guide portion;

(c) means for permitting the lateral movement of blade retaining portion with respect to said guide portion:

(d) blade means mounted to the base of said retaining portion for trimming paper as said paper moves longitudinally respect to said guide portion and through said printer and is biased against said blade means:

(e) means secured to an upper portion of said blade means for maintaining said paper against said blade means; and, (f) means for attaching said guide portion to said printer.

11. The apparatus as set forth in claim 10 wherein said attachment means comprise an adhesive surface.

12. The apparatus as set forth in claim 11 wherein said attachment means further comprises a guide member secured to and downwardly extending from a bottom surface of said guide portion.

13. The apparatus as set forth in claim 12 wherein said adhesive surface is provided on a surface of said downwardly extending guide member.

14. The apparatus as set forth in claim 13 wherein said downwardly extending guide member is flush with one edge of said guide portion.

15. The apparatus as set forth in claim 13 wherein said downwardly extending guide member is spaced from an edge of said guide portion.

16. The apparatus as set forth in claim 13 wherein said blade means is oriented at a generally downward taper thereby having a lower region smaller that its said upper region.

17. An apparatus mountable on a printer for trimming paper moving through said printer, comprising:

(a) a guide portion mountable on said printer and having supposing channel members provided on an upper portion thereof:

(b) a blade retaining portion having a base with opposing shoulder portions for being slidably accepted by said channel members of said guide portion;

(c) means for permitting the lateral movement of said blade retaining portion with respect to said guide portion;

(d) blade means mounted to the base of said moves retaining portion for trimming paper as said paper longitudinally with respect to said guide portion and through said printer and is biased against said blade means;

(e) means secured to an upper portion of said blade means for maintaining said paper against said blade means; and, (f) means for attaching said guide portion to said printer.

* * * * *